United States Patent [19]

Kuhnley

[11] Patent Number: 4,699,347

[45] Date of Patent: Oct. 13, 1987

[54] CHRISTMAS TREE STAND

[76] Inventor: Shirley J. Kuhnley, P.O. box 496, Monroe, Oreg. 97456

[21] Appl. No.: 866,367

[22] Filed: May 23, 1986

[51] Int. Cl.[4] ..... A47B 33/12

[52] U.S. Cl. ..... 248/516; 47/40.5; 47/42; 248/224.2; 248/288.5; 248/528; 403/77; 403/142

[58] Field of Search ..... 248/528, 529, 519, 520, 248/516, 288.5, 224.2; 47/40.5, 39, 42; 403/142, 141, 76, 77, 407.1, 49

[56] References Cited

U.S. PATENT DOCUMENTS

| | | | |
|---|---|---|---|
| 1,613,930 | 1/1927 | Burman | 248/528 X |
| 1,886,198 | 11/1932 | Krueger | 248/528 X |
| 2,621,878 | 12/1952 | Kruger | 47/40.5 X |
| 2,897,928 | 8/1959 | Selig | 403/407.1 |
| 2,908,461 | 10/1959 | Coffeen | 47/40.5 |
| 2,930,559 | 3/1960 | Lohr | 47/40.5 X |
| 3,119,585 | 1/1964 | Austenson | 47/40.5 |
| 4,477,049 | 10/1984 | Davis | 47/40.5 X |
| 4,620,813 | 11/1986 | Lacher | 248/288.5 X |

*Primary Examiner*—J. Franklin Foss
*Assistant Examiner*—David L. Talbott
*Attorney, Agent, or Firm*—John F. Ingman

[57] ABSTRACT

A tree stand, as for Christmas trees and the like, having in its preferred form a circular base with three legs extending upward in tripod form to an apex where a clamping mechanism is located. A ball is securely held between a clamp base located atop one leg, termed the socket leg, and a clamp top; the clamp top being located at the upper end of a clamp arm, an elongated member which pivots on the socket leg and whose lower end is spring biased away from the socket leg, thus forcing the clamp top upon the ball. The clamp, and thus the ball, is temporarily released by foot pressure on the lower end of the clamp arm, allowing alignment of the tree. The ball, with an attached tapered mating groove housing, is removably connected to a tree bracket having a tapered plate attached thereto. The tree bracket itself is laterally curved with protruding spikes formed on its inner surface, and is strapped to the side of the trunk to hold the tree securely. The tree stand may be reduced in size for storage.

3 Claims, 11 Drawing Figures

CHRISTMAS TREE STAND

BACKGROUND OF THE INVENTION

1. Field of the Invention

The present invention generally relates to tree stands, such as for Christmas trees. and more particularly is concerned with a tree stand which utilizes a foot releasable clamping device to facilitate erection and alignment.

2. Description of the Prior Art

Although many types of Christmas tree stands have been designed, they generally are quite difficult to set up and to adjust for proper alignment. In addition, they do not accomodate a wide variety of tree sizes, may be heavy and clumsy to store, and may interfere with the effective water uptake of the tree.

There is a need for a tree stand, for Christmas trees and the like, which is: simple to install, preferably without tools; easy to use so that one person can effect a wide range of adjustments with a minimum of effort; able to accomodate large and heavy trees with safety; light in weight; compactly and easily stored; dimensionally stable; and protective of the fresh tree trunk cambium to permit maximum water uptake.

SUMMARY OF THE INVENTION

The present invention provides a tree stand, as for Christmas trees, which is designed to satisfy the aforementioned needs. The invention embodies a foot actuated clamping mechanism about a ball which is removably attached to a tree retaining bracket, so that a wide range of alignment adjustments with a minimum of effort is possible.

Accordingly, the present invention provides a tree stand which, in its preferred embodiment, comprises a circular base having three legs extending upwards therefrom in generally tripod form, one leg being termed the socket leg. A two-piece hinged clamp is located proximate to the apex, the socket-like clamp base being formed on the socket leg and the clamp top pivotally attached to that leg with a leveraging clamp arm extending generally parallel to that leg towards the base. The clamp is strongly biased to a closed position by a spring attached between the socket leg and the clamp arm. The clamp arm may be serrated for traction near its lower end, whereat foot pressure will reduce or eliminate the clamping pressure so as to permit alignment of the tree.

A ball assembly comprises a ball, for movement and rotation within the socket, and a tapered mating groove connected to the ball. A tree bracket assembly comprises an laterally curved bracket which is strapped securely to the side of the tree trunk near the tree's base, the inner surface of the curved bracket being provided with a pattern of spikes so as to better grip and support the weight of the tree. A tapered plate is attached centrally on the outside of the curved bracket so as to be releasably inserted into the tapered mating groove of the ball assembly, to conveniently permit installation of the separate tree bracket assembly on the tree and subsequent attachment of the tree bracket assembly, and tree, to the remainder of the tree stand.

The socket leg may be detachable from the base so that, with a hinged attachment to the remaining two legs and their hinged attachment to the base, the tree stand is foldable to a generally flat configuration for storage.

DESCRIPTION OF THE PREFERRED EMBODIMENT

Figure 1:
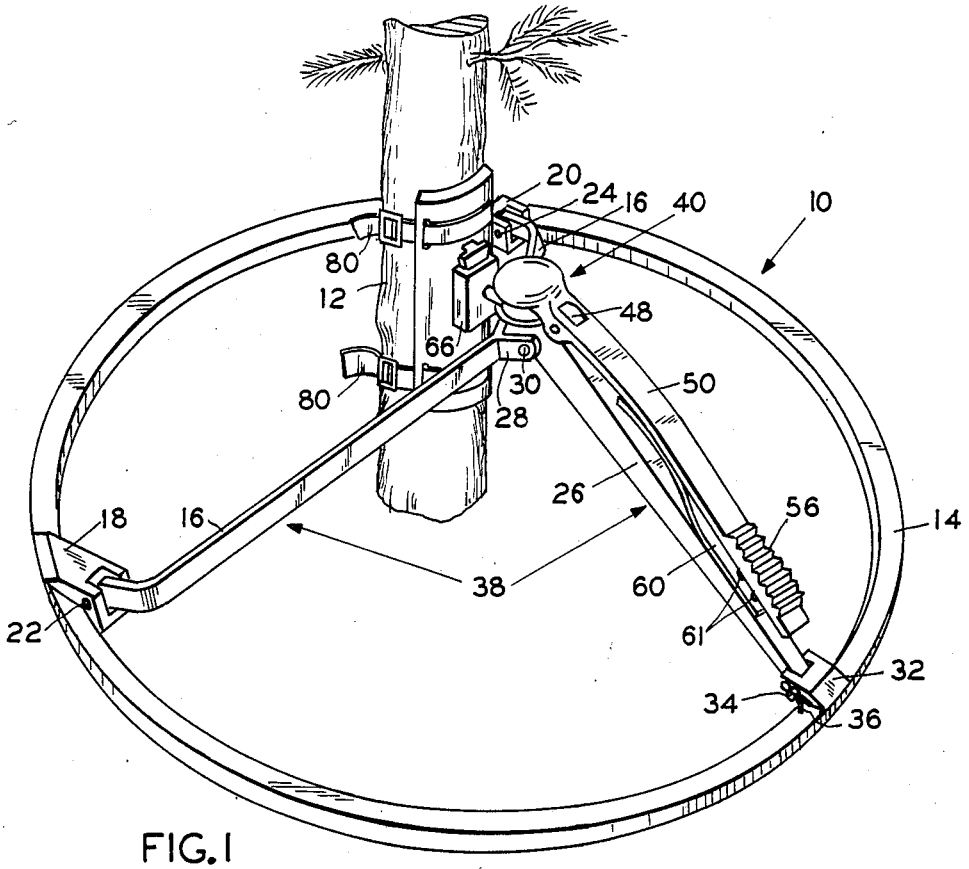
FIG. 1 is a perspective view of the tree stand of the present invention.

Referring now to the drawings, and more particularly to FIG. 1, there is shown in perspective the preferred embodiment of the tree stand 10 supporting a Christmas tree, as represented by tree trunk 12.

A circular ring base 14 provides the support for the tree stand 10. Extending upward from the ring base 14, in a tripod arrangement, are three legs which are equally spaced, i.e. 120 degrees apart, in their attachment to the ring base 14. Two legs are contained in a double legs assembly 16 which are hingedly attached at brackets 18 and 20 on ring base 14 by pins 22 and 24 respectively. The third leg, termed the socket leg 26, is hingedly attached to the double legs assembly 16 at bracket 28 by pin 30. The socket leg 26 is removably attached to bracket 32 on ring base 14 by a removable pin 34, secured by a cotter key 36 or other similar locking device. Thus the double leg assembly 16 and the socket leg 26 basically form the shape of a tripod 38 with its apex 40 located above the ring base 14. However, the socket leg 26 is shorter than the other two legs so that the apex 40 is located off-center, closer to bracket 32, thus allowing the held tree trunk 12 to be positioned centrally above the ring base 14, as will become more evident as the manner of connection of the tree trunk 12 to the tree stand 10 is described below.

Figure 2:
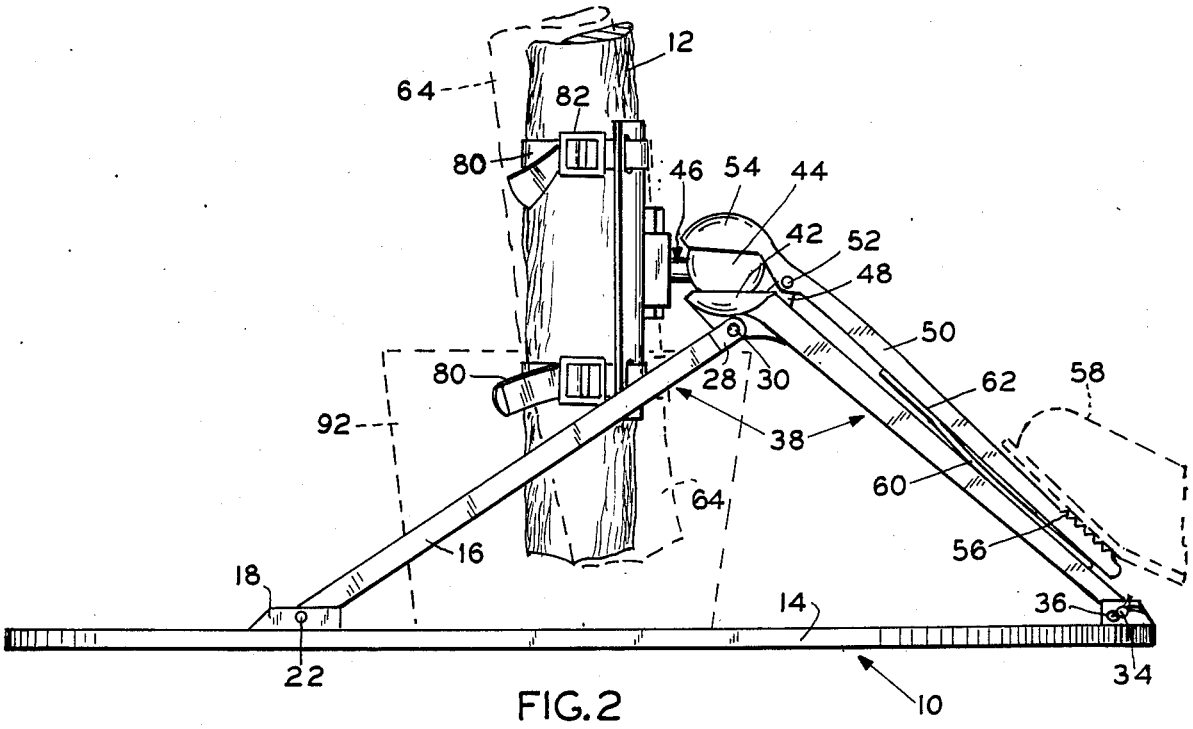
FIG. 2 is a side elevation view of the tree stand of FIG. 1 showing the clamping mechanism in the unlocked position due to foot pressure on the clamping arm.
Figure 3:
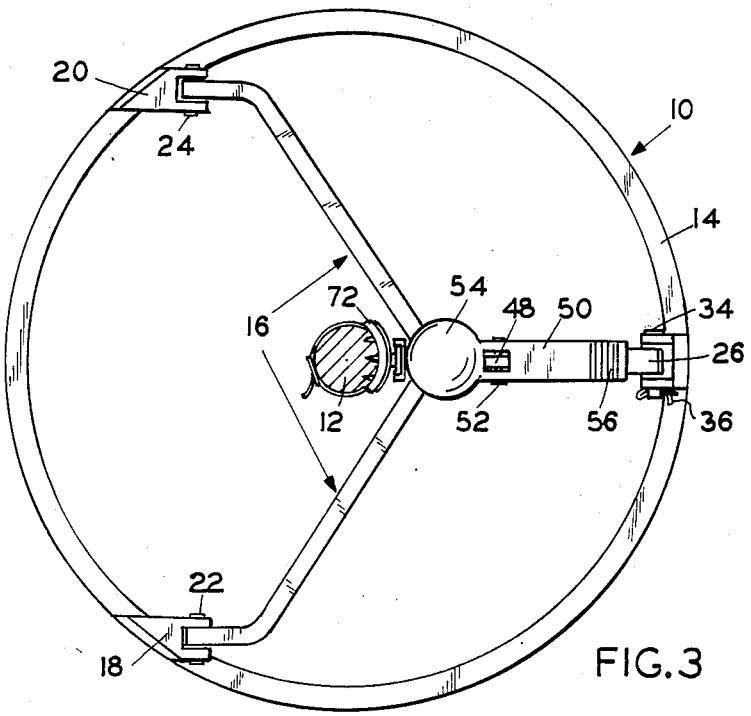
FIG. 3 is a top plan view of the tree stand of FIG. 1.
Figure 4:
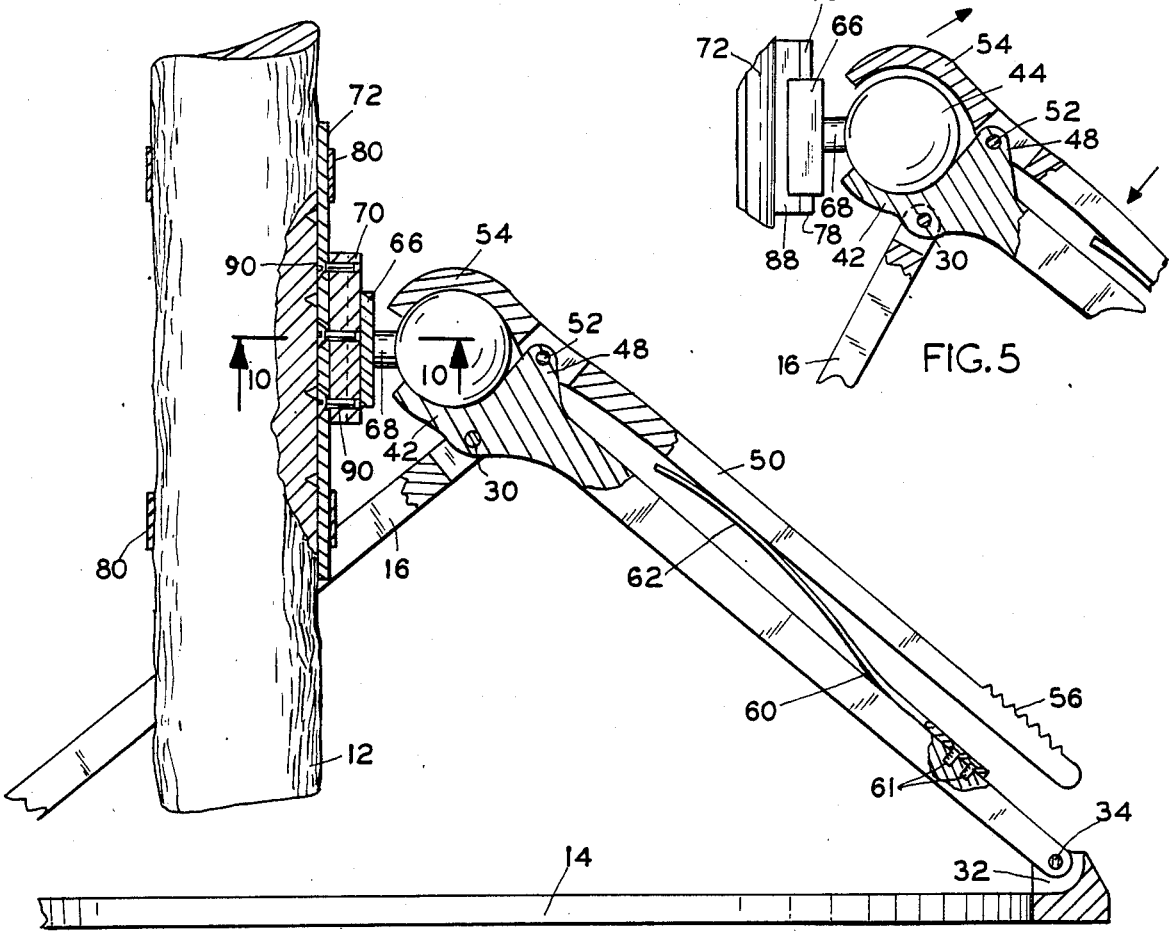
FIG. 4 is an elevation view of the tree stand of FIG. 1, with a portion broken away to more clearly show the clamping mechanism in locked position.

The socket leg 26 is designed with a clamp base 42, a socket, formed thereon or attached by welding, at its upper end, proximate to the apex 40 of the tripod 38. The clamp base 42 is concave in shape within its inner surface, so as to cradle the spherical-shaped ball 44 of the ball assembly 46. On the socket leg 26, adjacent to the clamp base 42, an ear 48 is formed upwardly so as to provide a location for connection to the socket leg 26 of the clamp arm 50. The clamp arm 50 is hingedly connected to the socket leg 26 by pin 52. The clamp arm 50 comprises a clamp top 54, whose inner surface is concave in shape, which presses forcefully down on the ball 44 held within the clamp base 42 so as to securely hold it in place. The clamp arm 50 may have a serrated portion 56 near its end adjacent to the ring base 14 so as to provide a non-slip surface for the application of the user's foot 58 thereto. A spring 60 is attached to the socket leg 26 by screws 61, and curves so as to press upwards against the clamp arm 50. The spring 60 thus holds the clamp top 54 forcefully atop the ball 44. A spring 60 with an applied force against the clamp arm 50 at point of contact 62 of approximately 80 lbs is preferred. With the leverage attained through the hinged pivot at pin 52 close to the clamp top 54, a sufficient force on the ball 44 is attained to hold a 100 lb. tree securely in a vertical position. As shown in FIG. 2, when sufficient pressure, as applied by a foot 58, is placed on the serrated area 56, the pressure on the ball 44 is reduced or eliminated, allowing movement and rotation of the ball 44 between the clamp base 42 and the clamp top 54, as illustrated by the phantom position of the tree trunk at 64.

Figure 5:
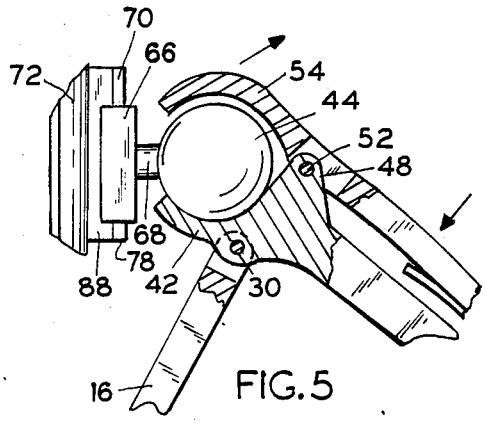
FIG. 5 is a fragmentary view of the tree stand of FIG. 2, with a portion broken away to more clearly show the clamping mechanism in released position.
Figure 6:
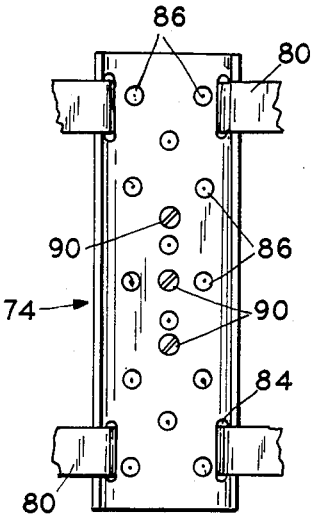
FIG. 6 shows an inside elevation view of the tree bracket assembly, illustrating the pattern of spikes and a manner of attachment of the tapered plate thereto.
Figure 7:
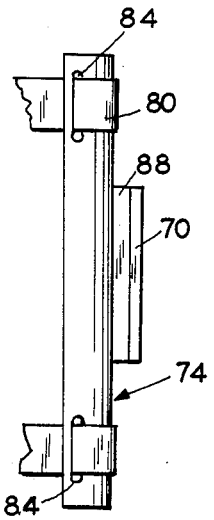
FIG. 7 show a side view of the tree bracket assembly of FIG. 6.
Figure 8:
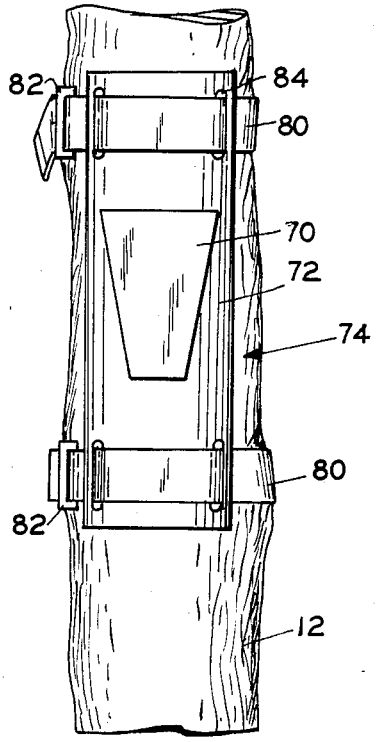
FIG. 8 shows an outside view of the tree bracket assembly of FIG. 6 separately strapped onto a tree.
Figure 9:
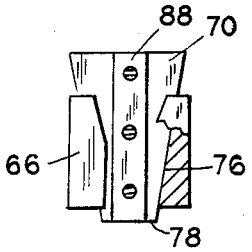
FIG. 9 shows the connection of the tapered plate of the tree bracket assembly with the mating groove of the ball assembly, as on line 9—9 of FIG. 10, with a portion broken away to illustrate the tapered groove.
Figure 10:
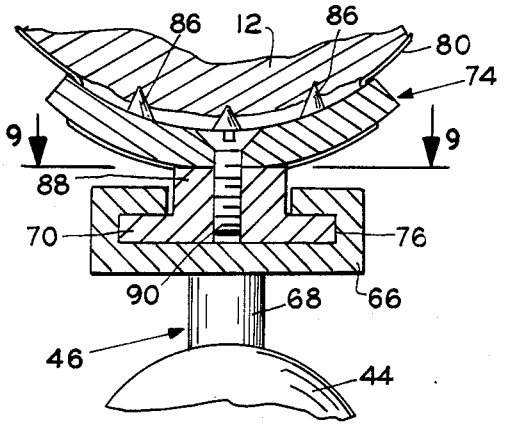
FIG. 10 shows a detailed partial sectional of the connection between the tree bracket assembly and the ball assembly, as on line 10—10 of FIG. 4.

The ball assembly 46 comprises the spherically-shaped ball 44, a mating groove housing 66 and a connecting rod 68, which joins the ball 44 and mating groove housing 66 together, as is best seen in FIG. 5 and FIG. 10. The ball 44, as located between the base clamp 42 and the clamp top 54, is formed with or attached to a connecting rod 68 which extends, when assembled and in use, generally horizontally outwards within the gap between clamp base 42 and clamp top 54. Attached or formed at the other end of the connecting rod 68 is a mating groove housing 66 which is designed to mate with a tapered plate 70 emanating from the tree bracket 72; both the tapered plate 70 and the tree bracket 72 being part of the tree bracket assembly 74. The housing 66, provides a tapered channel 76, open at the top and converging towards the bottom, in which the tapered plate 70 may be securely lodged by inserting it from above, as is better seen in FIG. 9 and FIG. 10. The tapered surfaces are self-holding; they require no fasteners to secure attachment and can be disassembled without the use of tools by tapping on that portion of the tapered plate 70 which extends through the mating groove housing 66, as can be seen at 78 in FIG. 9.

The tree bracket assembly 74, as formerly noted, comprises the tree bracket 72 with the tapered plate 70 extendedly connected thereto. The tree bracket 72 is a plate laterally curved so as to partially encircle the tree trunk 12. A pair of one-inch straps 80, with ratchet or standard pull-tight buckles 82 are threaded through strap slots 84 formed in the tree bracket 72, with the straps 80 encircling the tree bracket 72 and the tree trunk 12, so as to hold the tree trunk 12 securely to the bracket 72. Such straps 80 permit rapid installation, and readily adapt to irregular tree trunk shapes of various diameters. The inside of the tree bracket 72 has a pattern of spikes 86 located therein. The spikes 86, once pressed into the bark of the tree trunk 12, also provide support so that the straps 80 need not fully support the weight of the tree. The pattern of spikes 86 is utilized with the straps 80 so as to minimize harm to the fresh tree trunk cambium to eliminate interference with tree water uptake.

As noted above, a tapered plate 70 is attached, generally to the center of the tree bracket 72. The tapered plate 70 is designed with a longitudinal connecting bar 88 which is preferably mounted to the tree bracket 72 by means of three (3) self-threading screws 90, although other means of attachment should serve equally well.

The tree bracket assembly 74 may be completely removed from the remainder of the tree stand 10 to simplify the installation process, if desired, by sliding the tapered plate 70 from the mating groove housing 66 in the ball assembly 46. The tree bracket assembly 74 can be directly attached to the tree trunk 12 utilizing the straps 80, buckles 82 and spikes 86 and then reassembled to the remainder of the tree stand 10 for erecting and alignment.

When the tree stand 10 is assembled, the tree bracket assembly 74 is rigid until the user applies pressure, normally with the foot to the serrated portion 56 of the clamp arm 50. The application of pressure allows the ball 44 to move freely between the clamp base 42 and the clamp top 54 to permit easy positioning or alignment of the tree.

A variety of sizes of water-holding containers 92, may be placed beneath the mounted tree trunk, as seen in FIG. 2, to provide a source of water for the tree. Generally larger containers, as permitted by the design of the tree stand 10, are to be preferred so as to require fewer filling operations.

Figure 11:
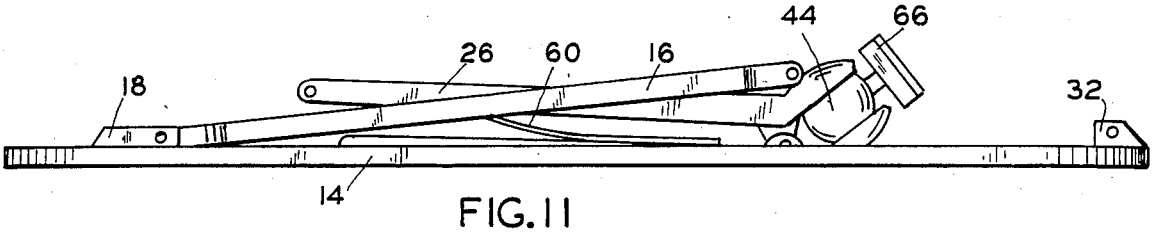
FIG. 11 illustrates the tree stand of FIG. 1, as folded for storage.

In the preferred embodiment, a 30-inch diameter ring base is utilized for trees with a lower trunk diameter of up to four-inches and a weight up to 60 lbs. When folded for storage, by removing the removable pin 34 and rotating the clamp arm 26 down and under to the proximate plane of the circular base 14, the folded tree stand 10 would then fit into a 30 inch diameter circle with approximately a four-inch thickness, as illustrated in FIG. 11.

It is thought that the tree stand of the present invention and its many attendant advantages will be understood from the foregoing description and that it will be apparent that various changes in form, construction and arrangement of the parts thereof may be made without departing from the spirit and scope of the invention or sacrificing all of its material advantages, the form hereinbefore described being merely an exemplary embodiment thereof.

I claim:

1. A tree stand, as for Christmas trees and the like, comprising:

(a) a tree bracket for attachment to the tree on the side of its trunk;

(b) a ball;

(c) means for removably attaching said ball to said tree bracket;

(d) a base;

(e) a plurality of legs, attached to said base, said legs extending upward and converging substantially to an apex; one leg being termed the socket leg; and (f) releasable clamping means attached to said legs substantially at said apex, for the purpose of grasping the said ball in a plurality of positions, said releasable clamping means comprising:

(1) a clamp base, in the form of a socket, which is formed or attached on said socket leg, said clamp base having an inner surface which is concave in shape;

(2) a clamp arm, having an upper end and a lower end, pivotally connected to said socket leg near the said upper end of said clamp arm and extending downward generally parallel to said socket leg, which said clamp arm includes a clamp top located at the upper end of said clamp arm and aligned with said clamp base, the inner surface of said clamp top being concave in shape;

(3) said ball being located between said clamp base and said clamp top; and (4) a spring operating between said socket leg and said clamp arm which biases said lower end of said clamp arm away from said socket leg, and as a result of said pivoting connection between said clamp arm and said socket leg, force said clamp top downward on top of said ball so as to firmly seize said ball between the said clamp top and said clamp base;

wherein, by application of pressure by the user on said lower end of said clamp arm against said bias of said spring, said clamp top is pivotally raised to release pressure on said ball and thereby permit user adjustment of the position of said ball and thus alignment of said tree bracket and the tree.

2. A tree stand, as for Christmas trees and the like, comprising:

(a) a tree bracket for attachment to the tree on the side of its trunk, said tree bracket including:

(1) a laterally curved plate, having an inner curved surface and an outer curved surface;

(2) said inner curved surface of said plate being formed with a plurality of protruding spikes, so as to provide penetration of the outer surface of a tree trunk for the purpose of holding the tree at a fixed place with respect to said bracket; and (3) strapping means which encircle said tree and said tree bracket, so as to hold, in combination with said spikes, the tree trunk securely to said tree bracket;

(b) a ball;

(c) means for removably attaching said ball to said tree bracket, which means include:

(1) a mating groove housing, rigidly attached to said ball in fixed, spaced relationship, having a top and a bottom, which provides a tapered channel open at the top and narrowing toward the bottom; and (2) a tapered plate, rigidly attached in fixed spaced relationship to said tree bracket, having a top and a bottom, for removably coupling with said mating groove housing, said tapered plate being broader at said top and narrower at said bottom, the taper of said tapered plate coinciding with said tapered channel of said mating groove housing;

(d) a base;

(e) three legs, attached to said base, said legs extending upward and converging to substantially form a tripod, said tripod having an apex; one leg, termed the socket leg, being shorter than the other two legs so that the apex of said tripod is located off-center above said base; and (f) releasable clamping means attached to said legs substantially at said apex, for the purpose of grasping the said ball in a plurality of positions, said releasable clamping means comprising:

(1) a clamp base, in the form of a socket, which is formed or attached on said socket leg, said clamp base having an inner surface which is concave in shape;

(2) a clamp arm, having an upper end and a lower end, pivotally connected to said socket leg near the said upper end of said clamp arm and extending downward generally parallel to said socket leg, which said clamp arm includes a clamp top located at the upper end of said clamp arm and aligned with said clamp base, the inner surface of said clamp top being concave in shape;

(3) said ball being located between said clamp base and said clamp top; and (4) a spring operating between said socket leg and said clamp arm which biases said lower end of said clamp arm away from said socket leg, and as a result of said pivoting connection between said clamp arm and said socket leg, forces said clamp top downward on top of said ball so as to firmly seize said ball between the said clamp top and said clamp base;

wherein, by application of pressure by the user on said lower end of said clamp arm against said bias of said spring, said clamp top is pivotally raised to release pressure on said ball and thereby permit user adjustment of the position of said ball and thus alignment of said tree bracket and the tree.

3. A tree stand, as for Christmas trees and the like, comprising:

(a) a tree bracket for attachment to the tree on the side of its trunk, said tree bracket including:

(1) a laterally curved plate, having an inner curved surface and an outer curved surface;

(2) said inner curved surface of said plate being formed with a plurality of protruding spikes, so as to provide penetration of the outer surface of a tree trunk for the purpose of holding the tree at a fixed place with respect to said bracket; and (3) strapping means which encircle said tree and said tree bracket, so as to hold, in combination with said spikes, the tree trunk securely to said tree bracket;

(b) a ball;

(c) means for removably attaching said ball to said tree bracket, which means include:

(1) a mating groove housing, rigidly attached to said ball in fixed, spaced relationship, having a top and a bottom, which provides a tapered channel open at the top and narrowing toward the bottom;

(2) a tapered plate, rigidly attached in fixed spaced relationship to said tree bracket, having a top and a bottom, for removably coupling with said mating groove housing, said tapered plate being broader at said top and narrower at said bottom, the taper of said tapered plate coinciding with said tapered channel of said mating groove housing; and (3) said tapered plate having a length so that when inserted into said mating groove housing, said bottom of said tapered plate extends beyond said bottom of said housing, thereby providing a means to facilitate disassembly by the tapping of said extended portion of said tapered plate.

(d) a base, which is circular in shape;

(e) three legs, attached to said base, said legs extending upward and converging to substantially form a tripod, said tripod having an apex; one leg, termed the socket leg, being shorter than the other two legs so that the apex of said tripod is located off-center above said base;

(f) releasable clamping means attached to said legs substantially at said apex, for the purpose of grasping the said ball in a plurality of positions, said releasable clamping means comprising:

(1) a clamp base, in the form of a socket, which is formed or attached on said socket leg, said clamp base having an inner surface which is concave in shape;

(2) a clamp arm, having an upper end and a lower end, pivotally connected to said socket leg near the said upper end of said clamp arm and extending downward generally parallel to said socket leg, which said clamp arm includes:

a clamp top located at the upper end of said clamp arm and aligned with said clamp base, the inner surface of said clamp top being concave in shape; and a serrated surface located near the lower end so as to provide a non-slip surface for application of pressure;

(3) said ball being located between said clamp base and said clamp top; and (4) a spring operating between said socket leg and said clamp arm which biases said lower end of said clamp arm away from said socket leg, and as a result of said pivoting connection between said clamp arm and said socket leg, forces said clamp top downward on top of said ball so as to firmly seize said ball between the said clamp top and said clamp base;

wherein, by application of pressure by the user on said lower end of said clamp arm against said bias of said spring, said clamp top is pivotally raised to release pressure on said ball and thereby permit user adjustment of the position of said ball and thus alignment of said tree bracket and the tree; and (g) means for reconfiguration for storage, said means comprising:

(1) pivoting attachment between the two of said three legs which are not the socket leg, and said base;

(2) pivoting attachment between the two of said three legs which are not the socket leg, and said socket leg; and (3) releasable attachment of said socket leg to said base;

so that, by releasing said attachment of said socket leg to said base, and pivotally rotating said socket leg downwards and under the other two legs, and pivotally rotating the other two legs downward, said tree stand is reduced in size for storage.

* * * * *